US007908062B2

(12) United States Patent
Corcoran

(10) Patent No.: US 7,908,062 B2
(45) Date of Patent: Mar. 15, 2011

(54) SYSTEM AND METHOD FOR PREPARING A WORKSITE BASED ON SOIL MOISTURE MAP DATA

(75) Inventor: Paul T. Corcoran, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 680 days.

(21) Appl. No.: 11/712,009

(22) Filed: Feb. 28, 2007

(65) Prior Publication Data

US 2008/0202777 A1 Aug. 28, 2008

(51) Int. Cl.

| | |
|---|---|
| ***A01B 69/04*** | (2006.01) |
| ***A01B 77/00*** | (2006.01) |
| ***A01B 79/00*** | (2006.01) |
| ***B60S 11/00*** | (2006.01) |
| ***B60P 1/00*** | (2006.01) |

(52) U.S. Cl. ..... 701/50

(58) Field of Classification Search ..... 701/23–26, 701/200, 201, 207–209, 50; 340/990, 995.1; 342/357.13, 643; 172/1, 2

See application file for complete search history.

(56) References Cited

U.S. PATENT DOCUMENTS

| | | | | |
|---|---|---|---|---|
| 3,625,303 | A * | 12/1971 | Cameron | 180/169 |
| 3,775,019 | A * | 11/1973 | Konig et al. | 404/133.1 |
| 4,467,652 | A * | 8/1984 | Thurner AB et al. | 73/573 |
| 4,600,997 | A * | 7/1986 | Cain et al. | 702/5 |
| 4,892,113 | A * | 1/1990 | Fattahi | 137/78.3 |
| 5,426,972 | A * | 6/1995 | Heirtzler et al. | 73/84 |
| 5,471,391 | A | 11/1995 | Gudat et al. | |
| 5,477,459 | A * | 12/1995 | Clegg et al. | 701/300 |
| 5,493,494 | A * | 2/1996 | Henderson | 701/50 |
| 5,524,560 | A * | 6/1996 | Carter | 111/200 |
| 5,631,658 | A * | 5/1997 | Gudat et al. | 342/457 |
| 5,646,844 | A | 7/1997 | Gudat et al. | |

(Continued)

FOREIGN PATENT DOCUMENTS

| | | |
|---|---|---|
| EP | 1571515 | 9/2005 |

(Continued)

OTHER PUBLICATIONS

Pending publication of U.S. Appl. No. 11/399,174; filed Apr. 6, 2006; Congdon et al.; Work Machine and Method of Determining Suitability of Work Material for Compaction.

(Continued)

*Primary Examiner* — Mark Hellner
*Assistant Examiner* — Ari M Diacou
(74) *Attorney, Agent, or Firm* — Liell & McNeil

(57) ABSTRACT

A soil moisture mapping based method for transferring soil for an earthworks construction project includes outputting signals based on soil moisture data and position data indicative of a location within a cut area or a fill area of the soil. The method further includes selecting a location within a cut area for obtaining fill soil or a location within a fill area for depositing fill soil based on the signals. A system for supplying soil for an earthworks construction project includes at least one machine having a sensor configured to sense soil moisture, and a receiver configured to receive position data corresponding with a location of the soil, and a signaling device configured to output signals based on the position data and soil moisture data. A transfer machine is included in the system and configured to selectively transfer fill soil between the cut area and the fill area based on the signals.

10 Claims, 4 Drawing Sheets

U.S. PATENT DOCUMENTS

| | | | | |
|---|---|---|---|---|
| 5,663,649 | A | 9/1997 | Topp et al. | |
| 5,727,900 | A * | 3/1998 | Sandstrom | 404/84.1 |
| 5,850,341 | A * | 12/1998 | Fournier et al. | 701/50 |
| 5,902,343 | A | 5/1999 | Hale et al. | |
| 5,942,679 | A | 8/1999 | Sandstrom | |
| 6,029,106 | A | 2/2000 | Hale et al. | |
| 6,041,582 | A * | 3/2000 | Tiede et al. | 56/10.2 A |
| 6,044,324 | A * | 3/2000 | Boerhave et al. | 702/5 |
| 6,061,618 | A | 5/2000 | Hale et al. | |
| 6,085,130 | A | 7/2000 | Brandt et al. | |
| 6,088,644 | A | 7/2000 | Brandt et al. | |
| 6,122,601 | A * | 9/2000 | Swanson et al. | 702/137 |
| 6,188,942 | B1 | 2/2001 | Corcoran et al. | |
| 6,216,071 | B1 | 4/2001 | Motz | |
| 6,349,775 | B1 | 2/2002 | Van der Lely et al. | |
| 6,389,360 | B1 * | 5/2002 | Alft et al. | 702/9 |
| 6,408,960 | B1 * | 6/2002 | Hidaka et al. | 180/6.38 |
| 6,421,990 | B1 | 7/2002 | Ohlemeyer et al. | |
| 6,460,006 | B1 * | 10/2002 | Corcoran | 702/137 |
| 6,510,367 | B1 | 1/2003 | McQuinn | |
| 6,741,949 | B2 | 5/2004 | Corcoran et al. | |
| 6,749,029 | B2 * | 6/2004 | Alft et al. | 175/24 |
| 6,751,540 | B2 | 6/2004 | Keefer et al. | |
| 6,880,643 | B1 * | 4/2005 | Zimmerman et al. | 172/4.5 |
| 6,937,939 | B1 * | 8/2005 | Shibusawa et al. | 702/22 |
| 6,973,821 | B2 * | 12/2005 | Corcoran | 73/78 |
| 7,623,951 | B2 * | 11/2009 | Congdon et al. | 701/50 |
| 7,731,450 | B2 * | 6/2010 | Congdon et al. | 404/84.5 |
| 2003/0069668 | A1 * | 4/2003 | Zurn | 700/245 |
| 2004/0050187 | A1 * | 3/2004 | Tritico et al. | 73/866 |
| 2005/0158129 | A1 * | 7/2005 | Chi et al. | 405/271 |
| 2005/0194461 | A1 * | 9/2005 | Goldberg et al. | 239/63 |
| 2007/0239336 | A1 * | 10/2007 | Congdon et al. | 701/50 |
| 2007/0268852 | A1 * | 11/2007 | Stegmaier et al. | 370/328 |
| 2008/0004809 | A1 * | 1/2008 | Tritico et al. | 702/2 |
| 2008/0202777 | A1 * | 8/2008 | Corcoran | 172/1 |

FOREIGN PATENT DOCUMENTS

| | | |
|---|---|---|
| WO | WO 95/30880 | 11/1995 |

OTHER PUBLICATIONS

Gesellschaft fur Geotechnik GmbH; Compactometer Dokumentations System; pp. 440-452, Published prior to Aug. 31, 1991.

H. Thurner, and A. Sandstrom;Continuous Compaction Control,CCC;European Workshop Compaction of Soils and Granular Materials, Paris, May 18, 2000, pp. 237-246;Stockholm, Sweden.

Pending publication of U.S. Appl. No. 11/418,926, filed May 5, 2006; Congdon; Method of Operating a Machine for Conditioning a Work Machine.

Pending publication of U.S. Appl. No. 11/517,066, filed Sep. 7, 2006; Potts et al.; Worksite Preparation Method Using Compaction Response and Mapping Information.

Pending publication of U.S. Appl. No. 11/517,065, filed Sep. 7, 2006; Corcoran et al.; Method of Operating a Compactor Machine Via Path Planning Based on Compaction State Data and Mapping Information.

* cited by examiner

SYSTEM AND METHOD FOR PREPARING A WORKSITE BASED ON SOIL MOISTURE MAP DATA

TECHNICAL FIELD

The present disclosure relates generally to techniques and machine systems for preparing earthworks construction sites, and relates more particularly to a process and control strategy for selectively transferring fill soil between work areas via the use of soil moisture map data.

BACKGROUND

Road and building construction and many other earthworks projects can require transferring relatively large amounts of soil from one location to another. In some instances, the topography of a worksite needs to be altered by leveling the native soil, removing it, depositing soil in certain areas, etc. The project may specify a particular site topography for engineering purposes, land architecture or even aesthetics. Similarly, factors such as the lift thickness of sequentially deposited layers of fill soil, soil composition and moisture content may need to be strictly controlled. Numerous different machines such as compactors, tractors, haul trucks, scrapers, excavators, soil remediation machines and many others may all be used in preparing site topography and working soil in a given project. A site manager is often tasked with orchestrating the operation of all of these machines, with a premium placed on meeting deadlines, minimizing downtime and maximizing efficiency and quality. It will thus be appreciated that the overall process of preparing a worksite can be quite complex and demanding work.

Engineers and other individuals involved in earthworks construction practices have long recognized that soil moisture content tends to relate to the suitability of soil to serve as a supporting substrate or otherwise remain stable over time. The relative ease of working soil in anticipation of its end use, such as by compacting, may also be affected by moisture content. Overly dry soil may undergo physical changes as time passes and moisture penetrates, compromising the soil's integrity as a supporting substrate. Wet soil can likewise shift or otherwise become unstable over time. It may also be difficult to achieve proper compaction of soils having improper moisture content, though the resulting problems may not become apparent until later. Achieving an optimum moisture content in fill soil is thus preferred, and often critical, to a project's long-term success.

As mentioned above, site preparation for many earthworks projects can require transferring relatively large volumes of soil from one location to another. It is common for site engineers to select a "cut area" for obtaining fill soil, and a "fill area" where transferred fill soil is to be deposited. Fill soil is typically transferred via haul trucks or scraper machines from a cut area to a fill area in stages, each time laying down a layer or "lift" of soil which is subsequently compacted with compactor machines to a presumably proper compaction state. If soil having an improper moisture content, e.g. too wet or too dry, is deposited in one or more of the lifts, however, labor intensive re-working of the soil is often required. Soil which is too dry may be moistened by spraying water on the soil with a water truck. Soil which is too wet is often disked to mix it and increase the available surface area for ambient drying. Discerning whether soil has the appropriate moisture content prior to its deposition, however, has heretofore been challenging or impossible in most instances.

Present practice is therefore to measure soil moisture at the end of a construction phase, for example with moisture/density meters. Such meters are used to determine whether the relative amount of water within a certain sample of soil is either too high or too low, and can determine the overall density of a sample. If the soil is not at a desired moisture content or not compacted sufficiently, the aforementioned reworking techniques are typically used, and the soil once again compacted. Rework of already laid soil to obtain an appropriate moisture content consumes a substantial proportion of manpower and resources in many earthworks projects. It also reduces the economic viability for contractors and takes time. It will thus be readily apparent that advances in soil moisture control and/or monitoring prior to depositing soil at a fill site would be welcomed in the construction industry.

The present disclosure is directed to one or more of the problems or shortcomings set forth above.

SUMMARY OF THE INVENTION

In one aspect, the present disclosure provides a system for preparing a worksite. The system includes at least one machine having at least one sensor mounted thereon which is configured to sense a parameter indicative of a moisture content of soil. The system further includes a receiver configured to receive position data of at least one of a cut area and a fill area, and a signaling device configured to output signals corresponding to the position data and data from the at least one sensor. The system still further includes at least one transfer machine configured to selectively transfer fill soil between the cut area and the fill area based at least in part on said signals.

In another aspect, the present disclosure provides a control system comprising at least one data processor, the at least one data processor being configured to receive sensor data from at least one sensor indicative of a moisture content of soil. The at least one data processor is further configured to receive position data of at least one of a cut area and a fill area. The control system further comprises a signaling device configured to output control signals based on the position data and the sensor data to a fill soil transfer machine.

In still another aspect, the present disclosure provides a method of preparing a worksite. The method includes receiving soil moisture data for soil of at least one of a cut area and a fill area, and receiving position data for at least one of a cut area and a fill area. The method further includes outputting at least one signal corresponding to the soil moisture data and the position data, and selecting at least one of, a location within a cut area for obtaining fill soil with a transfer machine and a location within a fill area for depositing fill soil with a transfer machine, based at least in part on the at least one signal.

DETAILED DESCRIPTION

Figure 1:
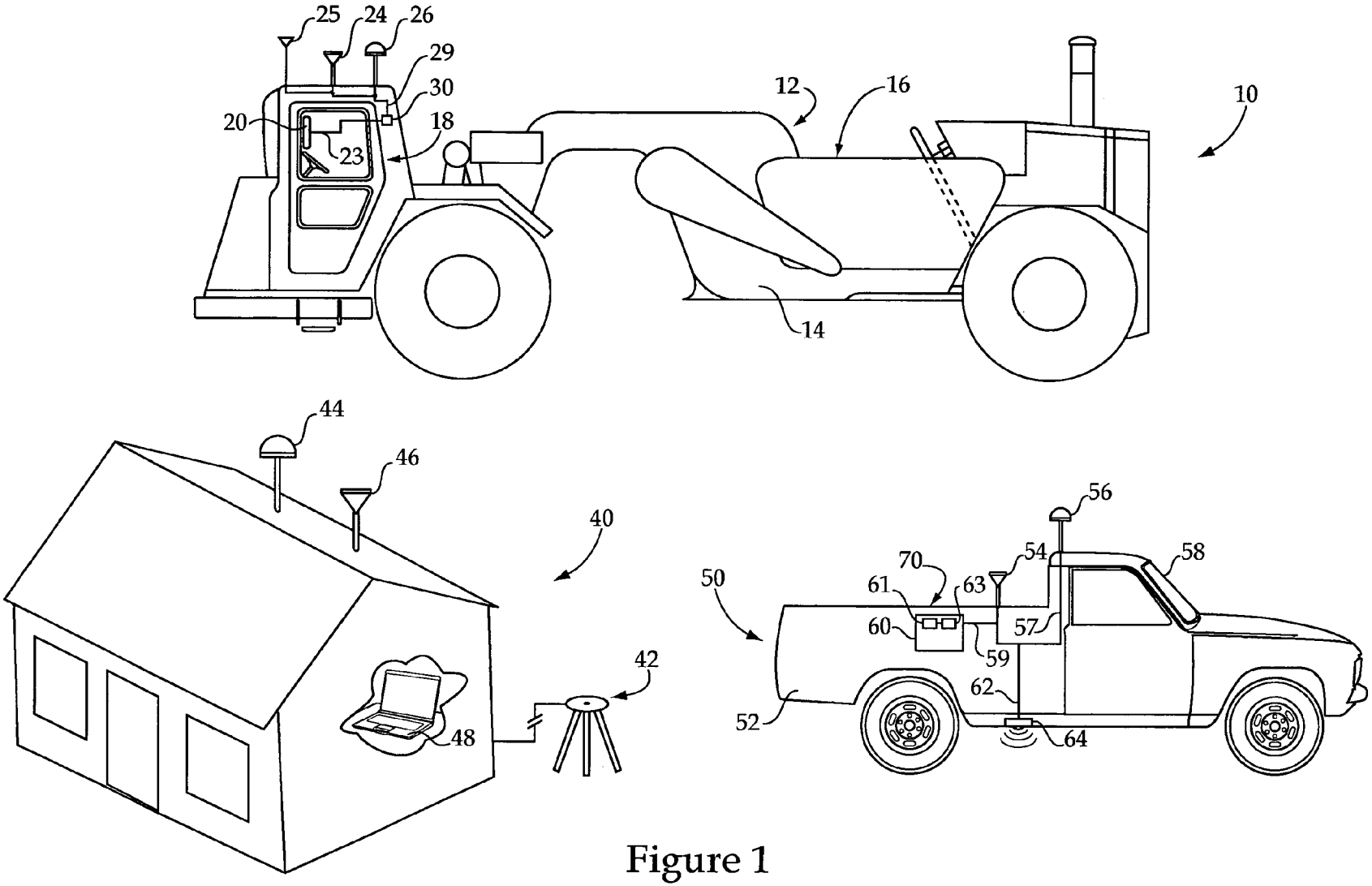
FIG. 1 is a schematic view of a system for preparing a worksite according to one embodiment.

Referring to FIG. 1, there is shown a system 10 for use in preparing a worksite. System 10 may include a first machine comprising a scraper machine 12 having a frame 14 and a scraper bowl 16. Machine 12 may be used to obtain fill soil at a first location, commonly known as a "cut area," and transfer a load of fill soil in bowl 16 to a second work area, generally referred to as a "fill area," where the fill soil load is deposited. Other types of machines and groups of machines configured to selectively transfer fill soil such as haul trucks, excavators and loaders might also be used in system 10 instead of, or in addition to, machine 12. System 10 may further include a second machine 50 configured to acquire soil moisture data used in generating soil moisture maps, as further described herein. To this end, machine 50 may include at least one soil moisture sensor 64 mounted thereon. Machine 50 may also include a receiver 56 such as a GPS receiver configured to receive position signals indicative of a position of machine 50 within a work area. Operation of one or more transfer machines such as machine 12 may be controlled or directed based on soil moisture data and position data, hereinafter "soil moisture map data," obtained via machine 50. In particular, soil moisture map data corresponding to locations of fill soil within a cut area and/or a fill area may be used in system 10 to select at least one of a cut location for obtaining fill soil within a cut area, and a fill location for depositing fill soil in a fill area. Selection of the cut and/or fill locations may be an automated action, or it might be carried out by a site manager, etc. As will be further apparent from the description herein, selectivity in obtaining and depositing fill soil via the use of soil moisture map data offers substantial advantages over the standard practice of end result testing for soil moisture content in earthworks projects.

In one embodiment, certain of the activities of machines 12 and 50 may be monitored and/or controlled at a base station 40. Base station 40 may include at least one data processor such as a computer 48 configured to receive data transmitted from machines 50 and/or 12. In one contemplated embodiment, a site manager or computer 48 may operate from base station 40 to render decisions and output control signals for machine navigation. Navigation of machine 12 may be controlled or directed from base station 40 based at least in part on soil moisture map data obtained via machine 50. Thus, base station 40 may serve as a communication link between machines 50 and 12, or other machines of system 10.

Other operations such as soil conditioning via disking or water spraying of soil in situ, or mixing of fill soil loads, for example, may also be directed from base station 40. Additional scrapers and other transfer machines, tractors, water trucks and a variety of other construction machines may be in communication with a site manager at base station 40, or computer 48, such that their movements and activities can be monitored and directed with the benefit of soil moisture map data. It is further emphasized that the illustration of system 10 in FIG. 1 is illustrative only. The present disclosure might be implemented in the context of a complex system of operatively coupled machines, all in communication with base station 40 and/or one another. For example, two or more scraper machines similar to machine 12 may have communication links with machine 50, either directly or via base station 40, the scraper machines being controlled or directed based on soil moisture map data acquired by machine 50. Alternatively, soil moisture map data acquisition and processing, as well as fill soil transfer, could all take place via a single machine. For example, scraper machine 12 could be equipped with the same or similar hardware as machine 50 and could move about a work area to acquire soil moisture map data, then obtain or deposit fill soil based on the soil moisture map data. or output signals to direct soil conditioning machines to selected areas. These various features and the attendant advantages will be further apparent from the following description.

As alluded to above, base station 40 may be used to receive data from machines 50 and/or 12. To this end, base station 40 may include a receiver 44 configured to receive data from machine 50. In one embodiment, soil moisture map data may be received from machine 50 via receiver 44. Receiver 44 may be coupled with computer 48 such that soil moisture map data received from machine 50 may be recorded in a memory of computer 48, for example in a database. After material is removed from a cut area or deposited in a fill area, additional soil moisture map data for the respective area may be obtained, and the soil moisture map data in the database updated. In still other instances, additional soil moisture map data may be used to increase the resolution of soil moisture map data stored in the database associated with computer 48. Base station 40 may further include a local GPS receiver 42 to enable relatively more accurate positioning information than that available with satellite-based GPS alone. A signaling device such as a transmitter 46 coupled with computer 48 may also be located at base station 40 to permit transmission of signals to control or direct activities of machine 12. Transmitter 46 might also be part of a simple radio communication link to allow a site manager to direct one or more of the machines of system 10 to take particular actions. While many earthworks construction projects will be undertaken with the use of a base station 40, it should be appreciated that in other versions of system 10, data processing, storage, manager decision making, etc. could all take place via one of the machines of system 10. In such an embodiment, rather than transmitting soil moisture map data to base station 40, machine 50 could transmit signals directly to machine 12 to control or direct activities of machine 12 via an on-board transmitter 54 of machine 50. In still further embodiments, rather than wirelessly transmitting soil moisture map data, machine 50 may simply record soil moisture map data which is later downloaded to computer 28, and used in selecting and/or controlling actions of machine 12, or integrated into a site management plan for later reference.

Turning to specific but not limiting elements of other components of system 10, machine 12 may include an operator cab 18 having a display device 20. Machine 12 may also include a first receiver 26 such as a GPS receiver configured to receive position signals whereby a location or relative location of machine 12 may be determined. Machine 12 may also include another receiver 25 for receiving signals transmitted from base station 40. In one embodiment, display device 20 may comprise a graphical display device, further described herein, whereas in other embodiments display device 20 might comprise a lamp or LED, for example, configured to convey information in an operator-perceptible manner. Display device 20 may also be configured to indicate at least one of, a selected location within a fill area for depositing fill soil and a selected location within a cut area for obtaining fill soil, responsive to signals transmitted from base station 40. This will enable an operator for machine 12 to follow directions received from base station 40 by viewing them on display device 20. Indicating such a selected location may take place via graphics, brightness, color, blinking areas, etc. of a map displayed on display device 20 for a given work area. Where a base station is not used, display device 20 could function by receiving signals directly from machine 50. In either case, system 10 will typically include a signaling device at one of base station 40 and machine 50 for outputting a signal to machine 12 which prompts generation of a particular display via display device 20. Machine 12 may further include a data processor 30 coupled with transmitter 24 and with receivers 25 and 26 via one or more communication lines 29, and coupled with display device 20 via another communication line 23.

Returning now to certain aspects of machine 50, the at least one sensor 64 of machine 50 may comprise a non-contact sensor configured to sense a parameter indicative of a moisture content of soil. In one embodiment, sensor 64 may comprise a microwave sensor configured to scan moisture content of soil without contacting the soil as machine 50 moves within a work area, for example a sensor of the type available from Hydronix, of Guildford, Surrey, United Kingdom. In other embodiments, commercially available contact soil moisture sensors may be used, a variety of which are commercially available. Machine 50 may further include a receiver 56 configured to receive position data indicative of a location of machine 50 within a work area, receiver 56 being mounted on an operator cab 58. Machine 50 may be a mobile machine having a frame 52 whereupon operator cab 58 is mounted, such that an operator can drive machine 50 about a work area to collect soil moisture data via sensor 64. Machine 50 might alternatively consist of an autonomous machine, or might even be a tow behind or hand held implement. A transmitter 54 may further be mounted on machine 50 to output signals corresponding to soil moisture data obtained via sensor 64 and machine position data obtained via receiver 56.

Machine 50 may further include a data processor or computer 60 coupled with sensor 64 via a communication line 62, with receiver 56 via another communication line 57 and with receiver 54 via yet another communication line 59. Computer 60 may thus be configured to receive position signals from receiver 56 and sensor inputs from sensor 64. Computer 60 may also include a memory 63 such as RAM, a hard drive, flash memory, etc. and a memory writing device 61 coupled with memory 63. Computer 60 may thus be used to store soil moisture map data, and update the soil moisture map data by overwriting or supplementing previously acquired data when additional data for a given area is obtained.

Computer 60, memory 61, memory writing device 63, sensor 64, receiver 56, and transmitter 54 may be elements of a control system 70 used in processing soil moisture map data and controlling or directing the operation of machine 12 and other machines which may be part of system 10. Control system 70 is illustrated as being mounted on machine 50, however, it should be appreciated that some or all of the components thereof might be located elsewhere in system 10. For example, memory 61 and memory writing device 63 might be components of computer 28 located at base station 40. Moreover, computer 48, receivers 42 and 44 and transmitter 46, as well as computer 30, display device 20, transmitter 24 and receivers 25 and 26 may all be parts of an integrated control system for system 10. Thus, control system 70 might include a plurality of computers, sensors, receivers and transmitters all in communication with one another, the location of which may vary substantially in system 10. In still other embodiments, a single data processor might be configured to receive soil moisture map data, select an appropriate fill and/or cut location and output a control signal based on the soil moisture map data to a transfer machine adapted to selectively transfer fill soil based on the control signal.

Figure 2:
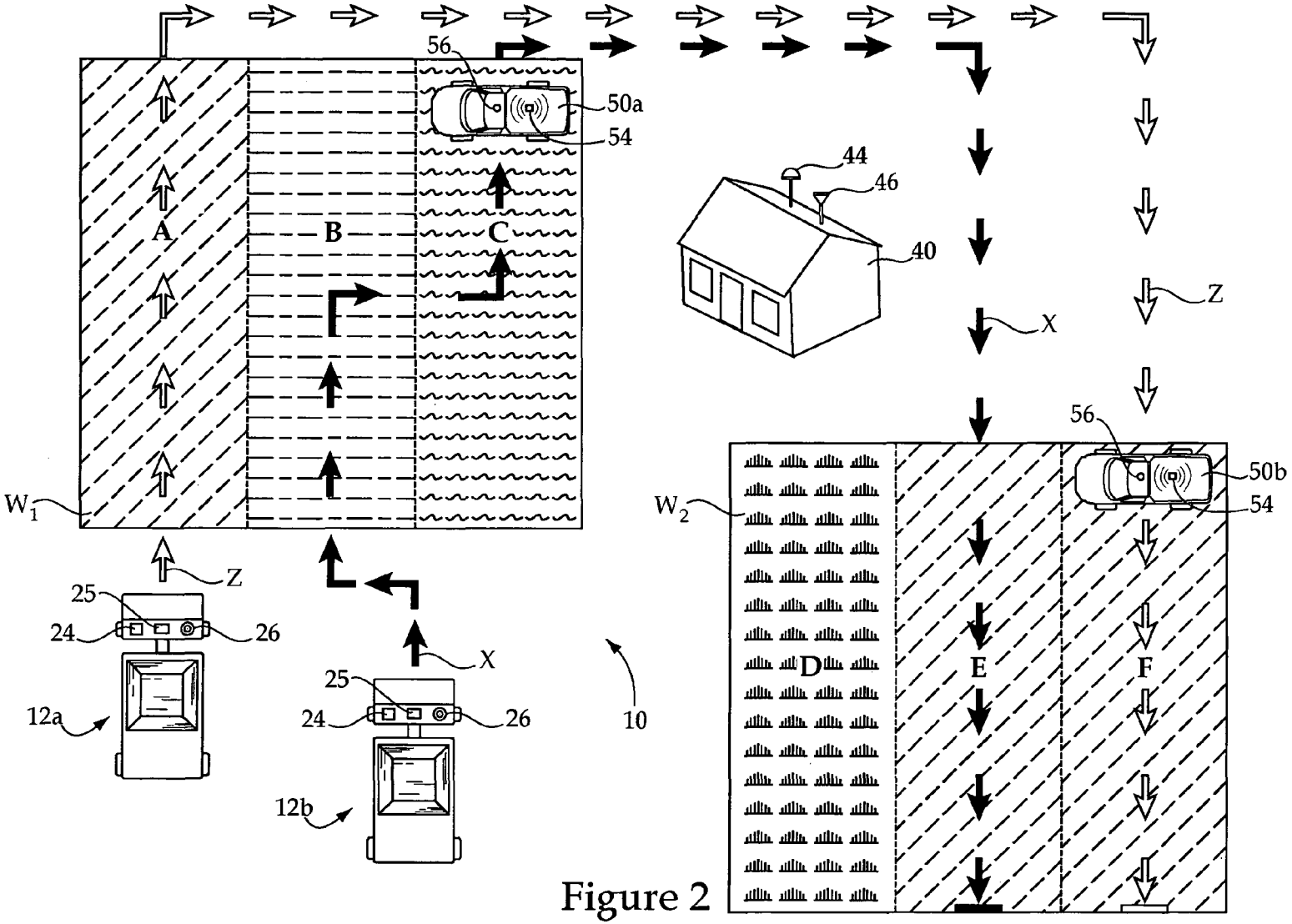
FIG. 2 is a schematic site model of an earthworks construction site.

Referring also now to FIG. 2, there is shown a schematic site plan model illustrating certain aspects of a fill soil transfer process using system 10 in accordance with the present disclosure. Two separate machines 50*a* and 50*b* are shown, each of machines 50*a* and 50*b* being similar to machine 50 shown in FIG. 1. Two separate transfer machines 12*a* and 12*b* are also shown, similar to machine 12 shown in FIG. 1. Machine 50*a* may be initially moved within a first work area $W_1$, comprising a cut area. As machine 50*a* is moved within work area $W_1$, soil moisture data for soil within work area $W_1$ may be sensed. Machine 50*b* may likewise be moved within work area $W_2$, for example a fill area, and soil moisture data for soil within work area $W_2$ sensed. Each of machines 50*a* and 50*b* may be moved about the respective work area until it has been traversed at least once, while receiving position data. By associating soil moisture data for the respective work areas with position data for machines 50*a* and 50*b*, soil moisture maps for the respective work areas may be generated. Soil moisture map data may be received at base station 40, one or a plurality of cut and/or fill locations selected, and corresponding signals output to machines 12*a* and 12*b* to enable their navigation within and between work areas $W_1$ and $W_2$ in accordance with the selected cut and/or fill locations.

Soil moisture may vary significantly and even irregularly across a given work area, depending upon such factors as soil type, slope, elevation, etc. Soil moisture mapping could therefore result in relatively complex soil moisture maps. Accordingly, it may be desirable to group different regions of a work area having different, but similar moisture content together. In other words, in some instances it may be most useful to divide a given work area into zones based on an average moisture content. In FIG. 2, work area $W_1$ is illustrated as it might appear having three different Zones, A, B and C, with three different average moisture levels. In particular, Zone A is shown with diagonal dashed lines corresponding to an approximately optimum soil moisture content, Zone B is identified with horizontal dashed lines corresponding to an overly dry soil moisture content and Zone C is shown with wavy lines corresponding to an overly wet soil moisture content.

Also illustrated in FIG. 2 are two separate travel paths, identified via arrows Z and X. Travel path Z indicates one possible path for scraper machine 12*a* which will pass through Zone A and thereby enable scraper machine 12*a* to obtain a full fill soil load of soil having optimum or near optimum moisture content. Travel path X indicates one possible travel path for scraper machine 12*b* which will pass partially through Zone B and partially through Zone C and thereby enable scraper machine 12*b* to obtain a full fill soil load which is approximately 50% too dry and approximately 50% too wet. The average moisture content of the fill soil load obtained via scraper machine 12*b* may therefore be close to an optimum moisture content. Various means such as on-board mixing augers are contemplated for use with transfer machines according to the present disclosure. Accordingly, machine 12*b* might be equipped to mix its fill soil load while in transit. In other instances, mixing or other soil conditioning could be carried out after the fill soil load is deposited.

Each of scraper machines 12*a* and 12*b* may therefore obtain fill soil loads having average moisture contents near optimum. In such cases, the fill soil load may be deposited at work area $W_2$ generally anywhere that fill soil is needed. In some instances, however, soil moisture mapping at the fill area may also be considered in selecting where to deposit fill soil loads with machines 12*a* and 12*b*. FIG. 2 illustrates a soil moisture map for work area $W_2$ having three Zones, D, E and F. In particular, work area $W_2$ is shown as it might appear where Zones E and F are found to have an optimum, or near optimum, average soil moisture content. Zone D, however, may have a moisture content so wet, for example, that soil working or ambient drying is desired prior to depositing any fill soil at all at Zone D. This condition of Zone D is illustrated via the X-shaped hatching in Zone D. Thus, in the illustrated example, travels paths Z and X are selected such that each of the corresponding fill loads of machines 12*a* and 12*b* are deposited in Zones E and F, but no fill soil is to be deposited yet at Zone D. After the fill soil loads are deposited, machines 12*a* and 12*b* may return to cut area $W_1$ to obtain additional fill soil loads, with the cut locations being selected based on the previously generated soil moisture map data, or on updated data acquired by moving machine 50*a* about the work area again.

It should be appreciated that while in certain embodiments, soil moisture maps might be generated for both of work areas $W_1$ and $W_2$, in other embodiments soil moisture mapping of only one of the respective work areas might take place. Moreover, mapping of the fill area might be undertaken prior to depositing fill soil, or only after fill soil has been deposited. Embodiments are also contemplated wherein soil moisture maps are updated after fill soil has been removed and/or after fill soil has been deposited. In such cases, machines 50*a* and 50*b* may be moved about the corresponding work area after fill/deposition with machines 12*a* and 12*b*, and additional soil moisture map data transmitted to base station 40. Following updating the soil moisture maps, different moisture contents of different zones may be revealed, and a different transfer strategy formulated on the basis of the updated maps.

Figure 3:
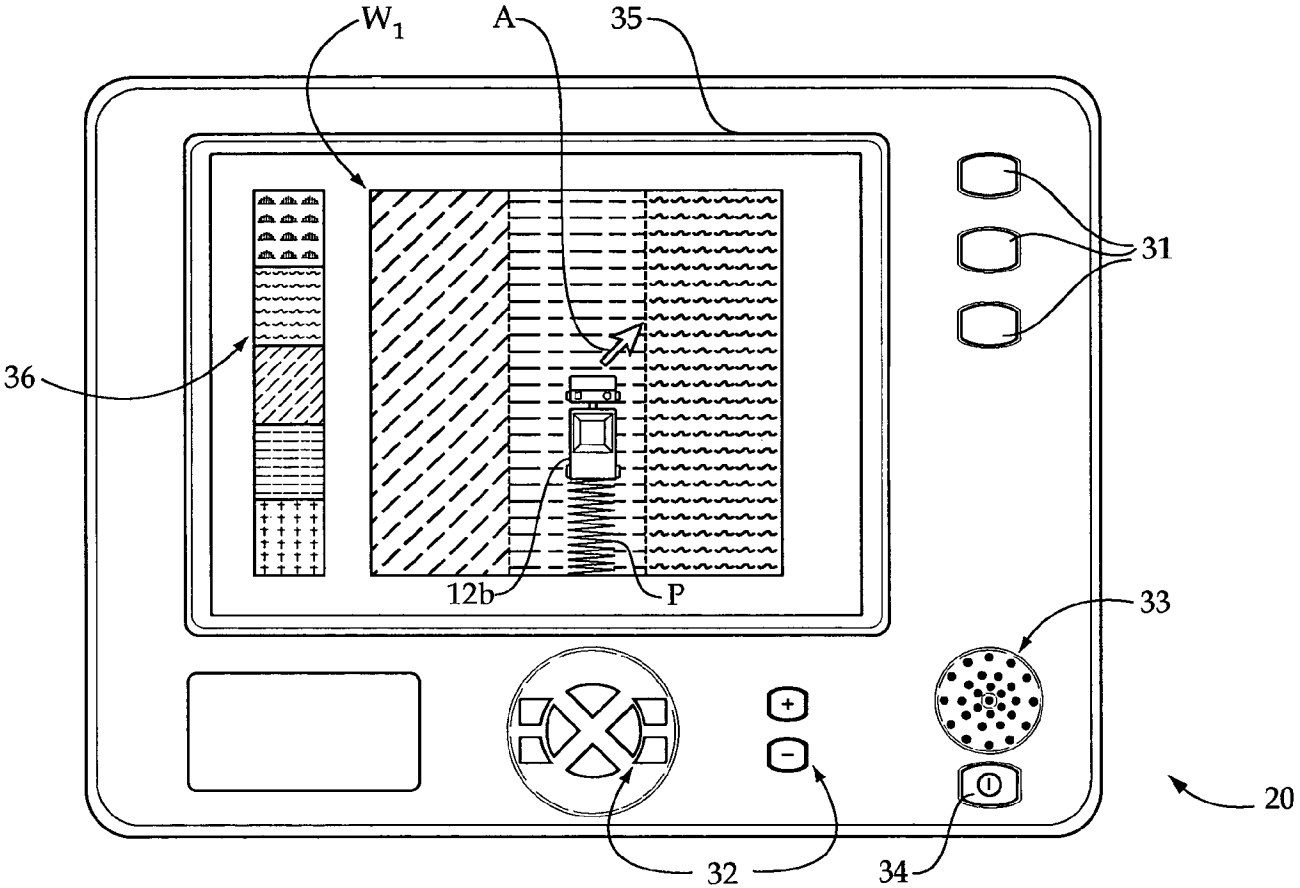
FIG. 3 is a diagrammatic view of a display device for use in the system of FIG. 1.

Referring now to FIG. 3, there is shown diagrammatically a display device 20 suitable for use in accordance with the present disclosure. In particular, display device 20 might be mounted in a transfer machine such as scraper machines 12, 12*a* and 12*b*. Display device 20 may include a display screen 35 whereupon a graphical representation of cut area $W_1$ may be displayed, for example. The graphical representation displayed on display screen 35 might also include an icon representing the machine wherein display device 20 is mounted, shown as machine 12*b* in FIG. 3, as well as an arrow A indicating an appropriate travel path for the machine within the work area. Reference numeral P is used to identify a different color display, or other graphical representation, distinguishing a portion of cut area $W_1$ across which machine 12*b* has already passed. Display device 20 may further include control buttons 31, a speaker 33, a power button 34, as well as a keypad 32. Display device 20 may also be configured to display an icon 36 which illustrates a scale of soil moisture content corresponding to each of a plurality of different soil conditions which may be displayed on display screen 35.

INDUSTRIAL APPLICABILITY

Figure 4:
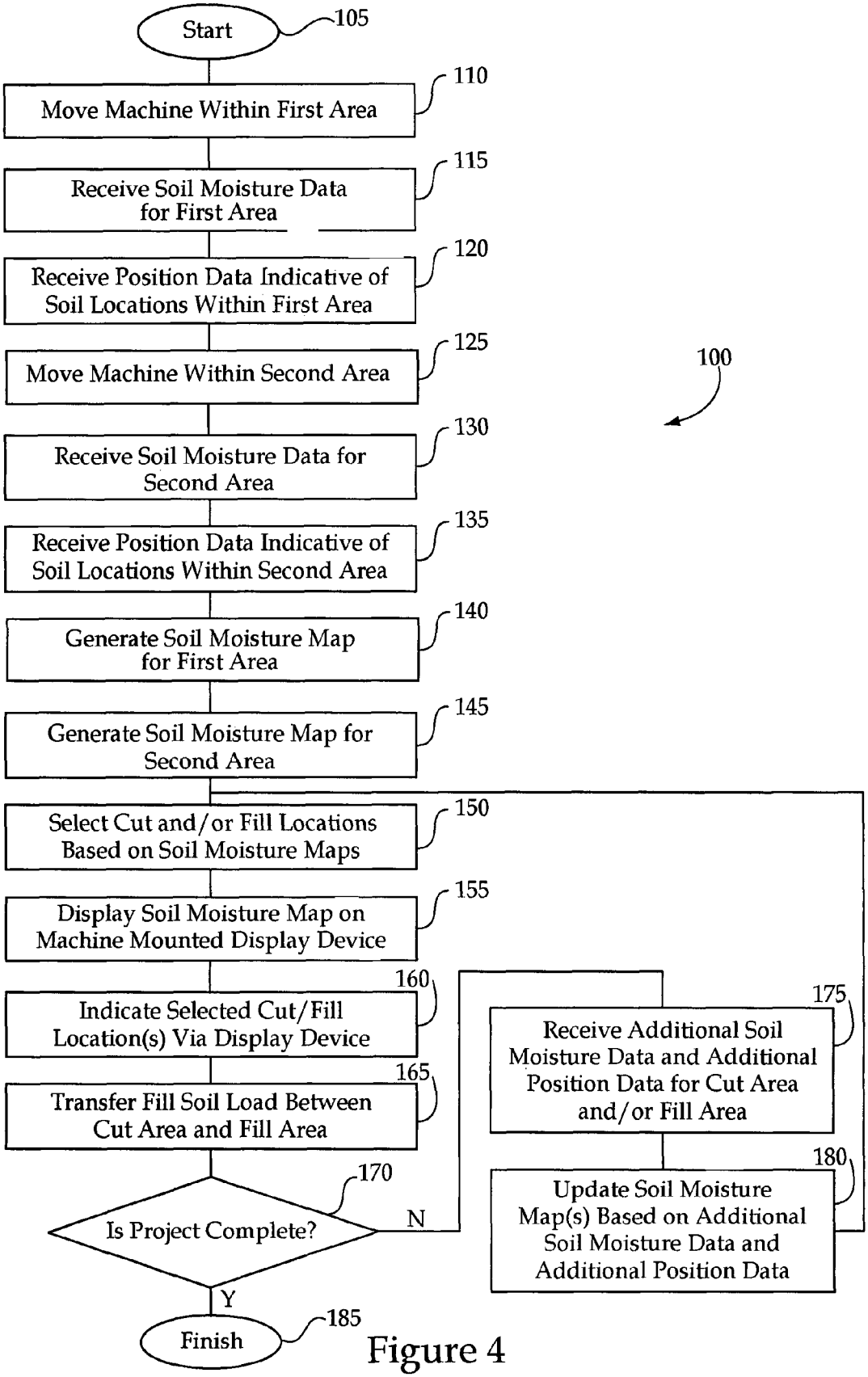
FIG. 4 is a flowchart illustrating a soil moisture mapping and fill soil transfer process according to one embodiment.

Referring to FIG. 4, there is shown a soil moisture mapping and fill soil transfer process 100 according to one embodiment. Process 100 may begin at Step 105, Start, and may then proceed to Step 110 wherein a machine such as machine 50 is moved within a first area. From Step 110, process 100 may proceed to Step 115 wherein soil moisture data, for example from sensor 64, is received. It should be appreciated that the area selected for soil moisture analysis via machine 50 may be either of cut area $W_1$ or fill area $W_2$. In some instances, both of cut area $W_1$ and fill area $W_2$ may be mapped, as described herein. From Step 115, process 100 may proceed to Step 120 wherein position data indicative of soil locations within the first area are received. Computer 60 may be configured to receive inputs from sensor 64, as well as inputs from receiver 56. Based on the respective inputs, processor 60 may generate soil moisture mapping signals corresponding to the soil moisture data and the position data received from the respective sensor 64 and receiver 56. The moisture mapping signals may be stored in memory 61, but might alternatively be transmitted directly to computer 48 at station 40 or directly to machine 12.

From Step 120, process 100 may proceed to Step 125 wherein a machine such as machine 50 or another machine is moved within a second area, one of areas $W_1$ and $W_2$ for example. From Step 125, process 100 may proceed to step 130 wherein soil moisture data for the second area is received. From Step 130, process 100 may proceed to Step 135 to receive position data indicative of soil locations within the second area.

In Step 140 and Step 145, once the necessary soil moisture and position data is received, soil moisture maps for the first area and the second area, respectively, may be generated. As described herein, the present disclosure is not limited to generating soil moisture maps via any particular device of system 10. For instance, the soil moisture map might be generated via computer 60 and displayed on a display screen of machine 50 or machine 12. The soil moisture maps might alternatively be generated via computer 48, and displayed at station 40. The map data might also be stored in memory, and used in directing operations of system 10 without actually displaying a map anywhere. As mentioned above, machine 12 could also serve as a machine to acquire soil moisture and position data and generate the appropriate maps. Following generating the soil moisture maps, and displaying the corresponding maps, process 100 may proceed to Step 150 to select a cut and/or fill location based on the soil moisture maps. In one embodiment, it is contemplated that a site manager at station 40 would be provided with soil moisture maps displayed via computer 48 of each of cut area $W_1$ and fill area $W_2$. The site manager could then make an appropriate decision as to what soil to move where, based on comparing the respective maps. Comparison of maps or soil moisture map data may also be performed via one of the computers of system 10.

From Step 150, process 100 may proceed to Step 155 wherein a soil moisture map is displayed on a machine-mounted display device such as display device 20. From Step 155, process 100 may proceed to Step 160 to indicate a selected cut/fill location via the display device. In this fashion, a machine operator such as an operator driving machine 12, can be directed to follow a particular route, cut and/or fill at a particular location, etc. From Step 160, process 100 may proceed to Step 165 to transfer a fill soil load between cut area $W_1$ and fill area $W_2$. From Step 165, process 100 may proceed to Step 170 to query whether the project or construction phase is complete. If at Step 170, fill soil transfer is not complete, process 100 may proceed to Step 175. If yes, process 100 may Finish at Step 185. In other words, at Step 170, soil moisture mapping and related activities may be suspended if transferring fill soil is no longer necessary, or is contemplated to be unnecessary for some time.

If fill soil transfer is to continue, at Step 175, additional soil moisture data and additional position data for the cut area and/or the fill area may be received. The additional soil moisture and position data may be obtained by again moving machine 50 within one of work areas $W_1$ and $W_2$. It is contemplated that removing fill soil from a particular area, as well as depositing fill soil at a particular area, may cause the soil moisture map(s) to change. Accordingly, once the additional data is received, at Step 180 the soil moisture maps may be updated on the basis thereof. From Step 180, process 100 may return to Step 150 to select a cut and/or fill location based on the updated soil moisture maps, and may then loop back through steps 155-170.

The present disclosure provides an altogether new strategy for selectively transferring fill soil between a cut area and a work area. This approach is contemplated to provide pertinent soil moisture data to a site manager or a computer such that soil having an appropriate moisture content may be deposited where it is most advantageous. In other words, dry soil might be deposited on top of wet soil, wet soil might be deposited on top of dry soil. Wet soils and dry soils may even be combined in a single fill soil load and mixed prior to or after deposition. By providing the relevant information beforehand, end result testing and rework associated with end result testing will be substantially reduced over current practice, or even eliminated. The overall quality of the construction project will be improved, and the time and effort required for quality assurance will likewise be improved over past practices. Whether the planning and implementation of an earthworks project is achieved via a single machine operated as described herein, or a large group of machines, the present disclosures promises dramatic improvements over the current state of the art.

It should further be appreciated that while the present disclosure discusses a relatively small number of steps in a worksite preparation process, a construction phase may involve the transfer of many fill soil loads, and moisture maps for one or both of the cut area and the fill area may be generated, resolved and/or updated numerous times. Each time soil moisture map data is acquired, subtle or significant changes in planning may take place. Moreover, worksite preparation may require many days of work, and the soil moisture content for a given area may change due to precipitation and ambient drying, as well as the removal or deposition of fill soil. The present disclosure enables monitoring of soil moisture in real time such that any changes in soil moisture content may be accounted for in an overall worksite preparation plan.

The present description is for illustrative purposes only, and should not be construed to narrow the breadth of the present disclosure in any way. Thus, those skilled in the art will appreciate that various modifications might be made to the presently disclosed embodiments without departing from the full and fair scope of the present disclosure. For example, while many construction projects transfer fill soil between relatively close cut and fill areas with scraper machines, the present disclosure is not thereby limited. In other embodiments, intermediary haul trucks might be used to transfer fill soil between relatively more remote locations for which soil moisture maps are generated. Rather than scrapers, loaders might be used in transferring soil, for example by loading a haul truck with fill soil from a location selected via the use of a soil moisture map. Thus, it will be readily apparent that a relatively large fleet of construction machines could have their operation controlled, monitored, influenced and tracked for the purpose of optimally transferring fill soil between locations. Other aspects, features and advantages will be apparent from an examination of the attached drawings and appended claims.

What is claimed is:

1. A control system comprising:

at least one data processor;

said at least one data processor being configured to receive sensor data indicative of a moisture content of soil of a cut area and a fill area; and said at least one data processor further being configured to receive position data of the cut area and the fill area;

wherein said control system further comprises a signaling device coupled with said at least one data processor, and is configured via the signaling device to output a control signal based on the position data and the sensor data to a fill soil transfer machine, wherein the at least one data processor is further configured to select a location within the fill area for depositing fill soil and a location within the cut area for obtaining fill soil, based at least in part on the sensor data and the position data, and responsively direct transfer of fill soil with the fill soil transfer machine via the control signal.

2. The control system of claim 1 further comprising a display device configured to receive signals from said signaling device and responsively display a soil moisture map, said display device further being configured to indicate at least one of, a location and a machine travel path, corresponding to a location selected via the at least one data processor.

3. The control system of claim 2 further comprising a memory configured to store soil moisture map data corresponding to signals from said signaling device and a memory writing device configured to replace stored soil moisture map data based on additional position data and additional sensor data for at least one of the cut area and the fill area.

4. The control system of claim 1, wherein the sensor data is received from a microwave sensor.

5. The control system of claim 1, wherein the at least one data processor is further configured to group together a plurality of regions of a work area based on moisture content.

6. The control system of claim 5, wherein the grouping of the plurality of regions of a work area is based on average moisture level.

7. The control system of claim 1, wherein the memory is further configured to store data relating to an optimum moisture level.

8. The control system of claim 5, wherein the at least one data processor is further configured to calculate a machine travel path based at least in part on the data relative to an optimum moisture level.

9. The control system of claim 1, wherein the at least one data processor is further configured to calculate a machine travel path based on a plurality of different moisture levels in a plurality of different regions of a work area.

10. A control system comprising:

at least one data processor;

a sensor in communication with the at least one data processor; and a receiver in communication with the at least one data processor;

the at least one data processor being configured to receive sensor data indicative of a moisture content of soil of a cut area and a fill area from the sensor, and to receive position data of the cut area and the fill area from the receiver;

the control system being configured to select a location within the fill area for depositing fill soil and a location within the cut area for obtaining fill soil, based on the sensor data and the position data, and being further configured to output a control signal responsive to selecting the locations which directs a fill soil transfer machine to transfer fill soil between the cut area and the fill area.

* * * * *